US011408632B2

(12) United States Patent
Allegretti et al.

(10) Patent No.: US 11,408,632 B2
(45) Date of Patent: Aug. 9, 2022

(54) DEW POINT CLIMATE GENERATOR AND CORRESPONDING CLIMATE CONDITIONING METHOD

(71) Applicant: CONSIGLIO NAZIONALE DELLE RICERCHE, Rome (IT)

(72) Inventors: Ottaviano Allegretti, San Michele all'Adige (IT); Paolo Dionisi Vici, Massa (IT)

(73) Assignee: Consiglio Nazionale Delle Ricerche, Rome (IT)

( * ) Notice: Subject to any disclaimer, the term of this patent is extended or adjusted under 35 U.S.C. 154(b) by 138 days.

(21) Appl. No.: 16/618,358

(22) PCT Filed: May 30, 2018

(86) PCT No.: PCT/IB2018/053841

§ 371 (c)(1),
(2) Date: Dec. 2, 2019

(87) PCT Pub. No.: WO2018/220548

PCT Pub. Date: Dec. 6, 2018

(65) Prior Publication Data

US 2020/0096219 A1 Mar. 26, 2020

(30) Foreign Application Priority Data

Jun. 1, 2017 (IT) ..... 102017000060109

(51) Int. Cl.
*F24F 11/84* (2018.01)
*F24F 5/00* (2006.01)
(Continued)

(52) U.S. Cl.
CPC ..... *F24F 11/84* (2018.01); *F24F 5/0035* (2013.01); *F24F 6/025* (2013.01);
(Continued)

(58) Field of Classification Search
CPC ..... H01M 8/04126; A61M 16/1085; F24F 2006/008; F24F 3/14; F24F 1/037;
(Continued)

(56) References Cited

U.S. PATENT DOCUMENTS

2008/0028771 A1* 2/2008 Nagae ..... F24F 1/0087 62/78

FOREIGN PATENT DOCUMENTS

AU 2005 202 670 A1 7/2005
CN 204 534869 U 8/2015
(Continued)

OTHER PUBLICATIONS

Translation of JPS5268748A (Year: 1977).*
(Continued)

*Primary Examiner* — Schyler S Sanks
(74) *Attorney, Agent, or Firm* — McAndrews, Held & Malloy, Ltd.

(57) ABSTRACT

A climate generator adapted to produce a flow of air at controlled temperature and at relative humidity values (tc, ic) is described, which includes a bubbler (100) which receives a flow of air to be conditioned (Ga), heat exchangers (120) associated with the bubbler (100) to adjust the temperature of the water volume (W) of the bubbler and/or to provide an amount of latent heat of evaporation to the aforesaid volume of water (W); and heaters (180) for heating the flow of air at the dew point (Gb) exiting from the bubbler (100) to the controlled temperature value of the flow of air, wherein the temperature of the volume of water (W) is established as a function of the controlled temperature and relative humidity values (tc, ic), so that the heating of the flow of air at the dew point (Gb) from the temperature of the water volume (W) to the controlled temperature value
(Continued)

determines a decrease in the relative humidity (ic) of the flow of air to the controlled relative humidity value.

11 Claims, 9 Drawing Sheets

(51) Int. Cl.

| | |
|---|---|
| ***F24F 6/02*** | (2006.01) |
| ***F24F 11/00*** | (2018.01) |
| ***F24F 110/22*** | (2018.01) |
| ***F24F 110/12*** | (2018.01) |

(52) U.S. Cl.
CPC ..... *F24F 11/0008* (2013.01); *F24F 2110/12* (2018.01); *F24F 2110/22* (2018.01)

(58) Field of Classification Search
CPC .... F24F 1/0007; F24F 1/0087; F24F 2110/22; F24F 2110/12; F24F 11/0008; F24F 6/025; F24F 5/0035; F24F 11/84
See application file for complete search history.

(56) References Cited

FOREIGN PATENT DOCUMENTS

| | | | | |
|---|---|---|---|---|
| DE | 19537332 | A1 | | 4/1997 |
| JP | S5268748 | A | * | 6/1977 |
| JP | 2002 168485 | A | | 6/2002 |
| JP | 2005 106363 | A | | 4/2005 |

OTHER PUBLICATIONS

International Search Report and Written Opinion, dated Sep. 26, 2018, in International application No. PCT/IB2018/053841, filed on May 30, 2018.

* cited by examiner

DEW POINT CLIMATE GENERATOR AND CORRESPONDING CLIMATE CONDITIONING METHOD

This application is a 371 of International Patent Application No. PCT/IB2018/053841, filed May 30, 2018, which claims benefit of Italian Patent Application No. 102017000060109, filed to the Italy Patent Office on Jun. 1, 2017, entitled "Dew Point Climate Generator and Corresponding Climate Conditioning Method," contents of both of which are hereby incorporated by reference in their entirety.

TECHNICAL SECTOR

The present invention falls, in general, in the field of climate conditioning systems for environments, and in particular the invention refers to a dew point climate generator and a corresponding climate conditioning method adapted to produce a flow of air at controlled temperature and relative humidity values.

PRIOR ART

Traditional conditioning systems for environments usually use an air cooling and condensing battery, an adiabatic saturator and two heating batteries, one upstream and one downstream of the adiabatic saturator, respectively.

In various types of climatic chambers known in the art, vapor is produced directly by a vaporizer.

Such systems have a modest energy efficiency and control accuracy of the conditioning system.

Such systems may be improved if they are equipped with modulating valves, which allow one to control the recirculation of the air and to partialize the flows of air, so as to increase the energy efficiency and the control accuracy. Despite this improvement, the energy efficiency and control accuracy remain non-optimal.

Moreover, in traditional dry-exchange heating batteries, in many operating conditions the components of a traditional air-conditioning system work in opposition, with negative consequences on the stability and efficiency of the system itself.

Another example of a climate conditioning system of the prior art are the systems used for conditioning display cabinets or museum cases. In such systems, passive control systems are often used consisting of buffers of suitably conditioned hygroscopic substances (e.g. silica gels). Despite advantages linked to simplicity and affordability, there are disadvantages due to the impossibility of controlling the temperature inside the display cabinet, as well as operating time limits that require frequent interventions to recondition the hygroscopic substances.

Furthermore, in the known air-conditioning systems, simplified active systems are usually used with a single cooling battery, for example a Peltier cell, which, in addition to having a very low efficiency, acts only as a cooling and dehumidification system with the obvious resulting operating limits and poor or non-existent temperature control.

SUMMARY OF THE INVENTION

The objects of the present invention are therefore to provide a climate generator and a climate conditioning process thereof for a flow of air with set temperature and stable humidity conditions when exiting, having less complexity, greater reliability, lower production cost and reduced maintenance requirements compared to the prior art.

The aforesaid objects are achieved by a climate generator having the features defined in claim 1 and by a climate conditioning process thereof having the features defined in claim 10.

Particular embodiments are object of the dependent claims, the content of which is to be understood as an integral part of the present description.

In summary, the present invention is based on the principle of controlling the climatic parameters of temperature and humidity of an environment through the production of a flow of air having the target temperature and relative humidity values, wherein the target temperature and relative humidity values are achieved by bringing a flow of air to be conditioned, of which the temperature and relative humidity values are unknown, to its dew point corresponding to a predetermined controlled temperature—different from the target temperature—and reaching the target level of relative humidity in the flow of air by heating the supply flow of air at the dew point from the controlled temperature to the target temperature.

At the target relative temperature and relative humidity values the mixture of air (air-vapor) thus defined has a determined dew point temperature.

Therefore, in order to obtain the target relative temperature and relative humidity values for the flow of air, the necessary amount of vapor is achieved by saturating the flow of air at the dew point temperature through a latent/sensitive thermodynamic transformation. The saturated air (100% relative humidity) and the dew point temperature is therefore heated to the target temperature (undergoing a second sensitive thermodynamic transformation) and consequently the relative humidity decreases to the target relative humidity value. The saturation step at the dew point takes place in a bubbler where there is water at a controlled temperature so as to bring the flow of air to the temperature corresponding to its dew point. The control is then carried out simply by controlling two temperatures: the temperature of the water in the bubbler and the target temperature. The target relative humidity is a function of the difference between the dew point temperature and the target temperature. The system therefore does not require relative humidity sensors to control the relative humidity, as it likewise does not require a condenser plus a saturator for regulating the relative humidity, since the bubbler, whatever the characteristics of the incoming air (to be conditioned), provides for introducing the right amount of vapor by condensing or releasing vapor.

Advantageously, a climate generator according to the invention may be sized to work with even high latent or sensitive thermal loads, or it may be miniaturized to operate in small environments such as display cabinets or museum cases.

The climate generator of the invention also allows air free of dust and other pollutants in the solid and gaseous phase to be obtained.

With a simple construction variant, the climate generator object of the invention may advantageously operate as a dynamic climate conditioning system which allows very rapid, almost instantaneous humidity variations to be performed under isothermal conditions.

BRIEF DESCRIPTION OF THE FIGURES

The aforesaid and further functional and structural features of the invention and its advantages will be described in the following detailed description of one embodiment thereof, given by way of non-limiting example, with reference to the accompanying drawings wherein.

DETAILED DESCRIPTION

Figure 1:
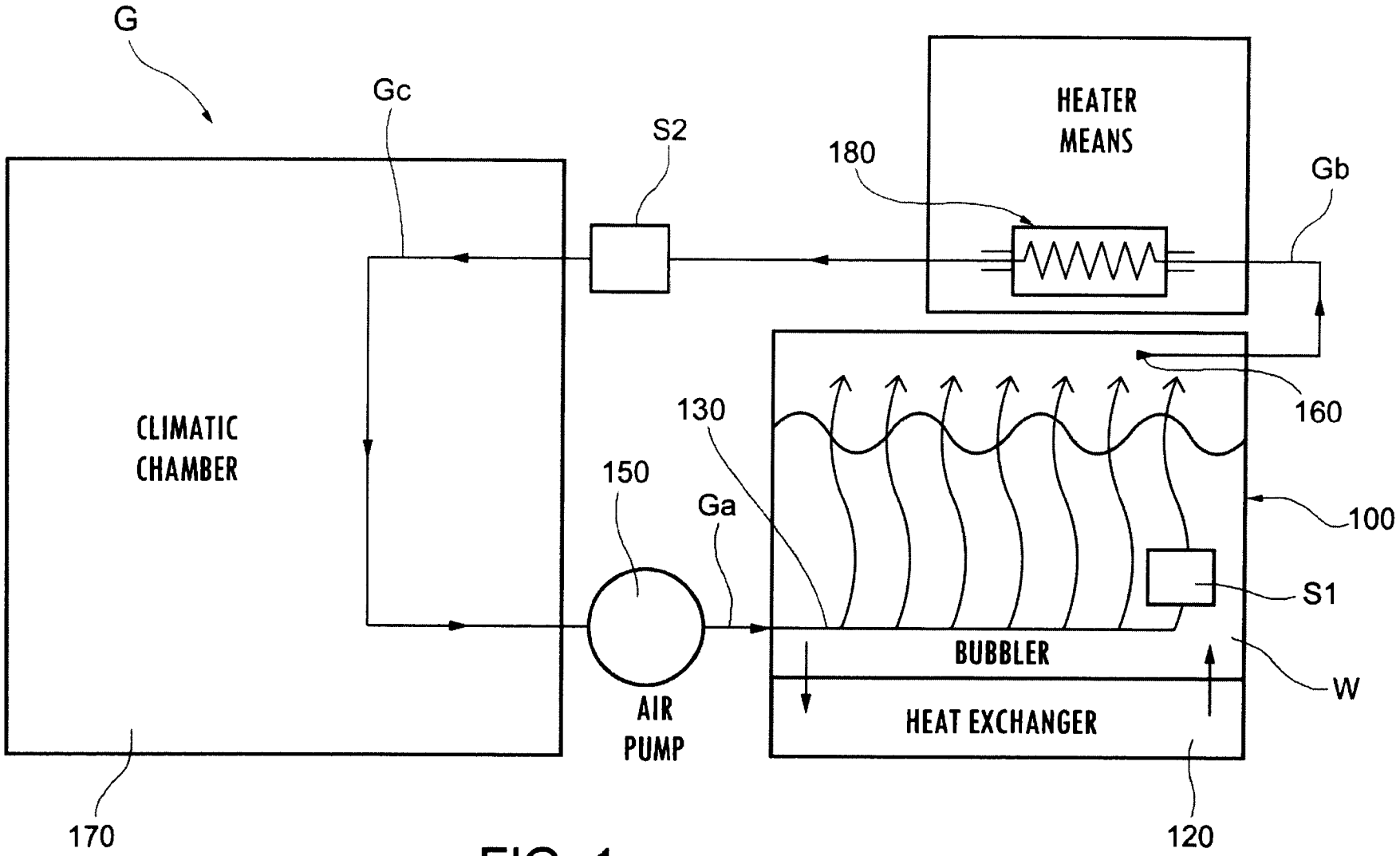
FIG. 1 illustrates a climate generator according to the invention.

With reference initially to FIG. 1, a first embodiment of the invention is illustrated wherein a climate generator according to the invention—indicated in the assembly at G—comprises bubbler means, such as a bubbler 100, adapted to receive a flow of air Ga to be conditioned and comprising a predetermined volume of water W at a controlled temperature in a closed-vessel or open-vessel water circulation circuit. In the first case, the bubbler 100 is a thermally insulated closed container, with pressure seal. The object of the bubbler means is to perform a heat and humidity exchange between the aforesaid volume of water at a controlled temperature (thermostated) and the flow of air in transit from the unknown temperature and relative humidity values of the incoming flow of air to a dew point temperature and relative humidity value of 100% of the exiting flow of air.

The temperature of the volume of water W in the bubbler is regulated according to the target temperature and relative humidity values required by the generator, as will be clearer in the following description, by means of heat exchanger means 120, for example a heat exchange battery, which may be a direct exchange type if positioned inside the bubbler, or an indirect exchange type if positioned outside the bubbler, when the latter is made with an open-vessel water circulation circuit. The heat exchanger means 120 are more generally responsible for a thermodynamic transformation of the volume of water W into the bubbler and of the flow of air to be conditioned that passes through it, including the administration of a quantity of latent heat of evaporation associated with the transformation from liquid phase to vapor phase in the volume of water W responsible for modifying the relative humidity characteristics of the flow of air to be conditioned.

Advantageously, to obtain a good temperature control, the temperature is controlled by a Proportional-Integral-Derivative controller, commonly abbreviated as PID. The climate generator further comprises means for supplying the flow of air Ga to be conditioned to the bubbler means, which comprise an air conduit 130, having, for example, a tortuous path such as a tortuous pattern provided with a plurality of micro-holes positioned on the bottom of the bubbler in such a way as to fractionate the air in transit in said volume of water W into bubbles, which allow an optimal sensitive and latent exchange between air and water, i.e., in order to optimally saturate the air and cool it to the dew point temperature, and connected to an air pump 150 adapted to circulate the air in the conduit and having a force such as to allow the flow of air to overcome the pressure of the water column formed by the volume of water W present in the bubbler 100.

The air pump 150 also has the object of providing air circulation by pushing the air inside an environment to be conditioned. Alternatively, the air may be conveyed to the climatic chamber by additional pump means arranged along the collector downstream of the bubbler.

More specifically, the pump 150 has an incoming particulate filter and operates with a capacity and pressure sized to compensate for pressure losses and to overcome the pressure of the water column in the bubbler; for example, the required minimum flow must be such as to guarantee a sufficient exchange and distribution of the air in the environment to be conditioned and climatic stability conditions, based on the latent-sensitive load in the environment and at the desired speed for achieving the conditions of climatic stability. For example, an ultra-stable air-conditioning pump in a museum case is sized for around 100 exchanges/hour (determined by the ratio between the pump flow and case volume). Empirical tests have shown acceptable functionality with exchange times around 1 exchange/hour (for a pump flow rate of 1 $m^3$/h for a 1 $m^3$ case). For museum cases placed in stable conditions and requiring restrictive specifications on sound emissions, lower values may be sufficient.

The bubbler 100 is advantageously designed and sized in the height of the water column, in the volume of water W and in the fractioning of the bubbles according to the flow of air to be treated so that the air-water exchange efficiency is maximized.

In the bubbler 100, the flow of air Ga bubbles through the volume of water W present, becoming saturating with water vapor and reaching the temperature of the volume of water, and an air flow collector 160, located in the upper part of the bubbler, is adapted to channel the flow of saturated air Gb at the dew point towards a climatic chamber 170 served by the climate generator.

Heater means 180, such as a heating battery, are arranged downstream of the bubbler 100 and adapted to heat the flow of air Gb exiting the bubbler before it is admitted into the climatic chamber 170 to which the climate generator is associated.

In a cyclic embodiment, the deteriorated flow of air Ga to be conditioned that the supply means provide to the bubbler means is taken from the climatic chamber.

Figure 2:
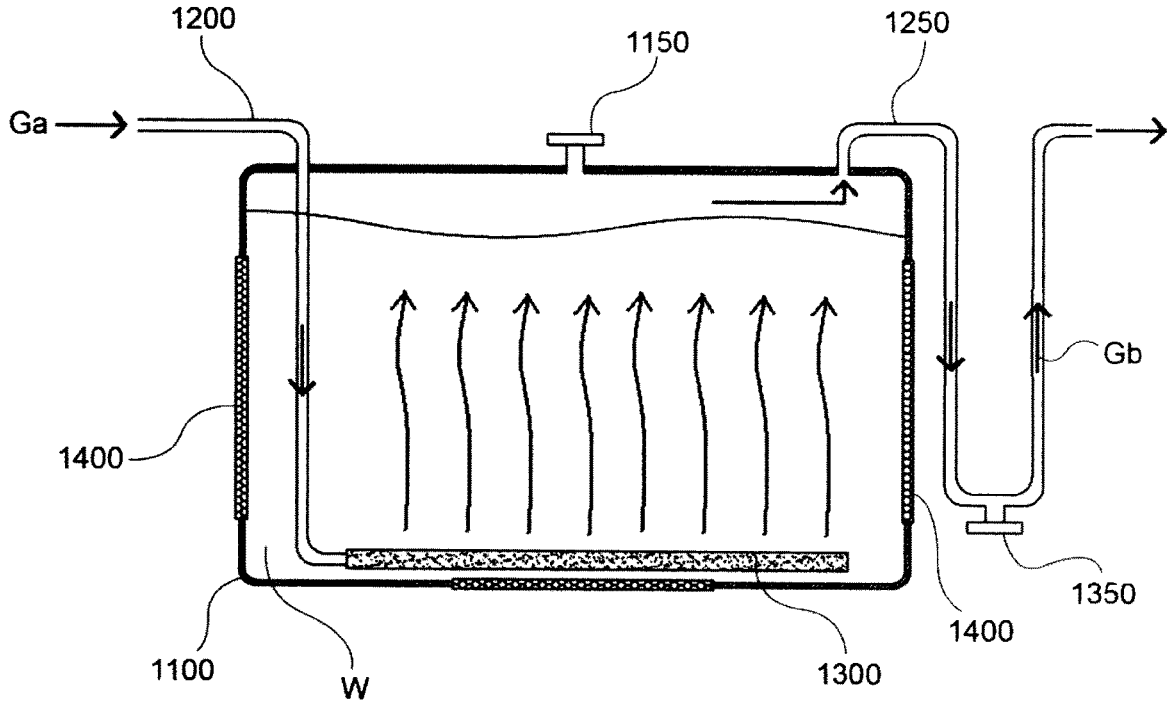
FIG. 2 illustrates a currently preferred embodiment of a bubbler of the climate generator according to the invention.

In a currently preferred embodiment, shown in FIG. 2, the bubbler 100 comprises a watertight, pressure-tight, thermally insulated container 1100, the volume of which is filled ¾ full of water thermostated to the dew point temperature (Tr) of the flow of air. The container 1100 has a sealed closure 1150 on the upper side for topping up the water volume and inspection. The container is connected on the upper side with two conduits, respectively for adduction and outflow of air, indicated at 1200 and 1250. The air adduction conduit 1200 extends to the bottom of the container 1100 where it is connected to a porous tube 1300. The air outflow conduit 1250 is equipped with a condensate trap to prevent any liquid from being transported with the air to the heater means 180. The condensate trap is formed by shaping the outflow conduit on a tortuous double-C path and providing a condensate collection and drainage container 1350 at the lower section. The shape and volume of the container 1100 are sized so that the thermodynamic transformation of the incoming air is complete. Excess water volumes are recommended for the purpose of reducing variations in the water level.

The porous tube 1300 (such as an embodiment of a tube with a plurality of micro-holes) is preferably placed on the bottom of the container 1100 and connected to the air flow adduction conduit 1200. The porous tube 1300 has the purpose of introducing the flow of air into the water volume in the form of small bubbles which increase the surface/volume ratio of the bubbles as much as possible in order to maximize the air/water exchange.

The heat exchanger means 120 constitute a system for thermostating the volume of water W of the bubbler means, and comprise, for example, heat exchange batteries placed directly inside the container 1100 or outside of it, in which case the container 1100 is connected to an open-vessel water circulation circuit that brings water from the container 1100 to the batteries, and vice versa. The heat exchange batteries are for example made by means of a coil made of a thermally conductive material (such as copper) within which a refrigerated gas circulates from a refrigeration unit, or by means of Peltier cells 1400 integrated on the walls of the container which have a lower efficiency but do not generate noise.

The heater means 180 constitute an air temperature control system which has the purpose of heating the flow of air coming out of the bubbler, which is at the dew point temperature and with 100% relative humidity at the target temperature value. They comprise, for example, electrical resistors located inside a thermal insulated outflow conduit and canalization of the air towards the case, wherein the electrical resistors are arranged near the case or in the connection area between the case and the conduit, or directly inside the case.

Improved embodiments in terms of energy yield, operating limits, control accuracy, safety and reliability include:

1) The provision of an open/closed cycle switching system, through the use of a three-way modulating valve provided to partialize the recirculation of air from the case to the pump, controlled in such a way as to control the recirculation of the air coming from the environment to be conditioned (closed cycle) or the inflow of air from the outside (open cycle), depending on the most favorable condition for energy consumption. In the case of an open cycle, it is necessary to provide means for measuring the temperatures and humidity of the outside air.

2) The provision of a bypass system for the flow of air, through the use of a three-way modulating valve to prevent the passage of the flow of air through the bubbler means and the heater means when it is detected that the air entering the pump does not require conditioning.

3) The provision of a refrigeration heat recovery system through additional heat exchanger means suitable to advantageously use the heat produced by a water refrigeration system of the bubbler means to preheat the air exiting from the bubbler means and entering the heater means.

4) The provision of a pre-cooling system for the flow of air entering the bubbler means by an additional heat exchanger immersed in the volume of water of the bubbler means within which the flow of air is circulated, for example, along to a tortuous path, before the flow of air is released in the volume of water, so that the flow of air is cooled according to the current temperature of the volume of water, thus increasing the heat exchange efficiency of the bubbler means.

5) The provision of a system for heating the volume of water in the bubbler means by using electrical resistors immersed in the volume of water of the bubbler means, adapted to allow a temperature increase in the water volume in applications requiring particular conditions of high temperature and relative humidity in the environment to be conditioned. Alternatively, in the case wherein Peltier cells are provided, the heating occurs by inverting the polarity of the supply current to the aforesaid cells.

6) The provision of a system of heaters diffused by low-intensity electrical resistors placed in peripheral areas to be conditioned, to achieve a more homogeneous heating of the flow of air entering the environment to be conditioned.

7) The provision of a retroactive control system and relative humidity alarm through at least one relative humidity sensor arranged inside the environment to be conditioned and connected to a control system provided to activate alarm means and/or to adjust retroactively the temperature of the volume of water.

8) The provision of an auxiliary ventilation system by means of one or more fans placed inside the environment to be conditioned avoids the stratification of the air, allowing the most homogeneous climatic conditions to be reached.

9) The provision of a control system for the level of the water column in the bubbler means. The level of the water column in the bubbler means is subject to variations, as it may increase due to the moisture condensation of the flow of air adducted in the volume of water if the dew point temperature of the adducted air is higher than the temperature of the volume of water or conversely may decrease due to the release of moisture from the volume of water to the flow of air in transit if the dew point temperature of the adducted air is less than the temperature of the volume of water. The water level control system is provided to keep the water column level constant in the bubbler means (adding or removing water) or to generate an alarm indicating a change in such level.

10) The provision of a system of air flow circulation pumps arranged in parallel for a more accurate air flow control, a reduction in consumption and an increase in reliability of the climate generator as a whole, in the case of pump failure.

The following describes a climate conditioning procedure that may be implemented by means of the climate generator object of the invention.

Such method is based on a two-step transformation, illustrated in FIGS. 5, 6 and 7, of a flow of air which first passes through the bubbler means and subsequently is heated until a set temperature is reached, indicated hereinafter as tc.

During its passage through the bubbler means, the incoming flow of air Ga, which has enthalpy values ha with titer or absolute humidity xa, temperature to and relative humidity ia, undergoes a sensitive transformation, i.e., it is heated or cooled to a temperature tb, and is saturated with water vapor, completing a latent transformation, whereby the exiting flow of air Gb has enthalpy values hb, with titer or absolute humidity xb, temperature tb and relative humidity ib=1.

Subsequently, the flow of air Gb in the passage through the heater 180 is heated from the temperature tb to the temperature tc to obtain the air flow conditions produced by the climate generator Gc, conditioned to the desired values of enthalpy hc, with titer or absolute humidity xc, temperature tc and relative humidity ic, respecting the following proportions $xc=xb$, $tc \geq tb$ and $ic \leq ib$.

By setting the temperatures tb and tc, it is possible to obtain the desired climatic conditions at the given values of controlled temperature tc and of controlled humidity ic. In effect, once the desired controlled temperature tc is established, the desired condition of controlled relative humidity is obtained by adjusting the temperature of the water of the bubbler means at the dew point temperature tr of the flow of air, i.e., by adjusting tb=tr, which is a function of the desired temperature tc and the desired relative humidity ic.

Figure 3:
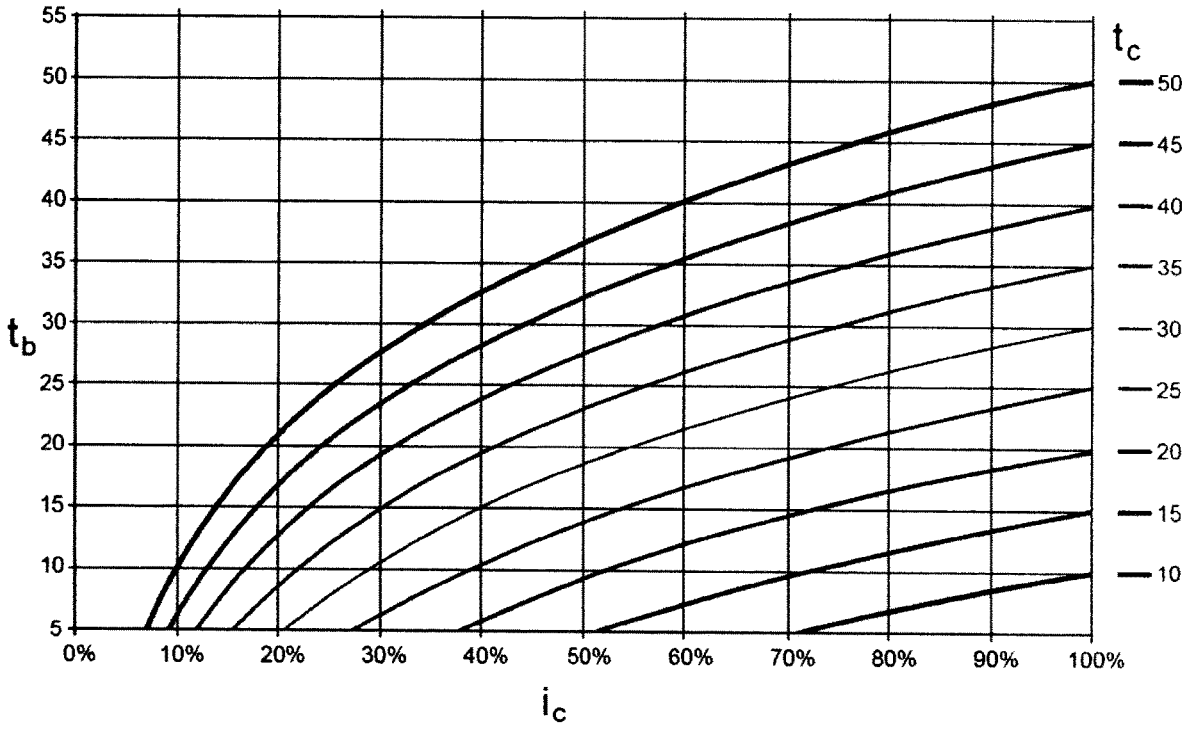
FIG. 3 is a graph of the relationship of dependency of the dew point on the air temperature and on the relative humidity.

The relative humidity control ic is therefore carried out by controlling the water temperature in the bubbler means, which is assumed for simplicity to correspond to the temperature of the flow of air exiting the bubbler means tb. For this purpose, a function tb=f(tc, ic), wherein the temperature value tb is obtained as a function of the controlled temperature ic and the controlled relative humidity ic, may be directly implemented in the control. Such function is expressed by the following formula:

$$Tb=(237,7*(((17,27*tc)/(237,7+tc))+LN(ic)))/(17,27-((17,27*tc)/(237,7+tc))+LN(ic)))$$

where LN indicates the natural logarithm, and by the graph of FIG. 3.

Figure 4:
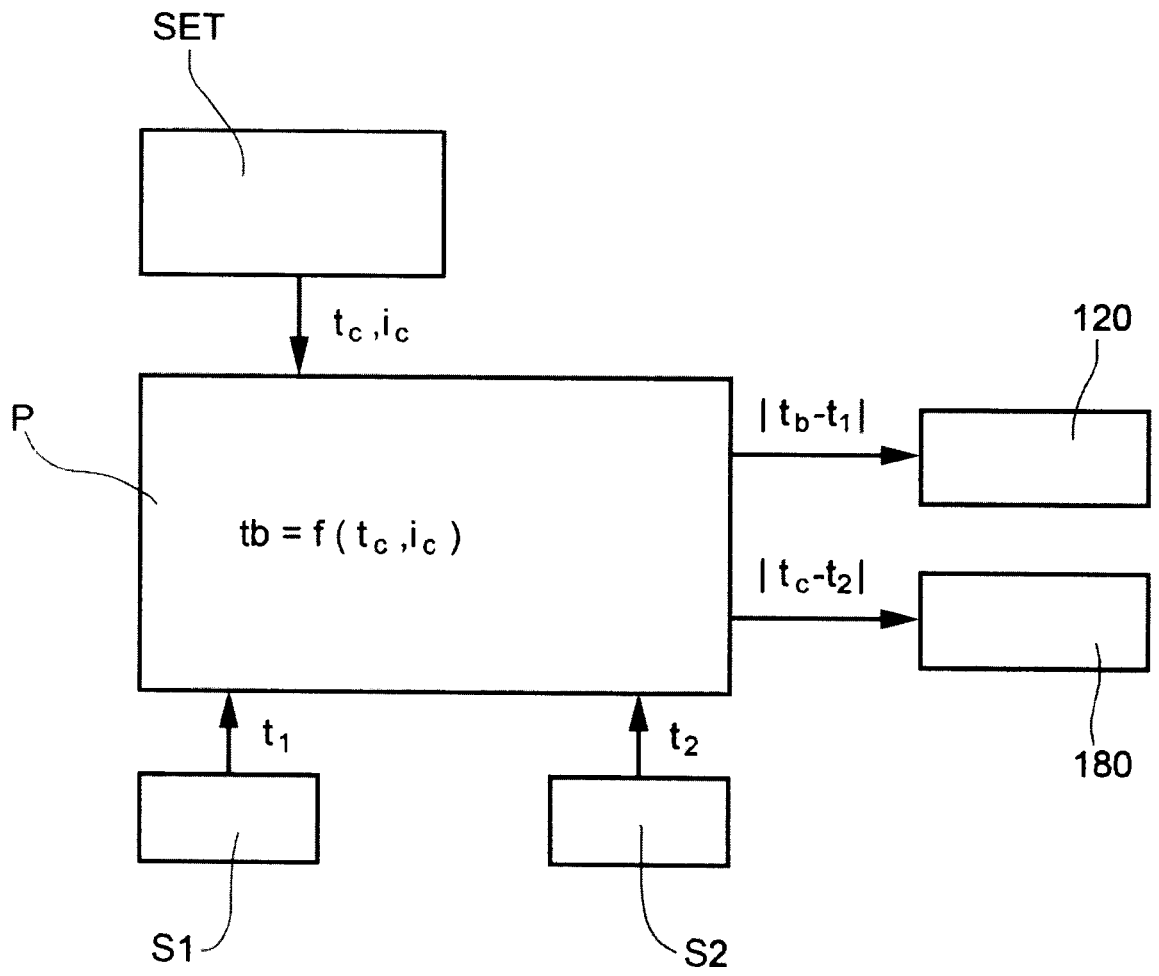
FIG. 4 shows an illustrative circuit diagram of a climate generator control system object of the invention.

FIG. 4 shows an illustrative circuit diagram of a climate generator control system object of the invention. Processing means P, such as a microprocessor, have three inputs, respectively coupled to a first temperature sensor S1—associated with the bubbler means 100 and adapted to detect the real temperature t1 of the water volume W, to a second sensor S2—associated with the heater means 180 and adapted to detect the real temperature t2 of the flow of air Gc produced by the climate generator, and to SET means for setting the desired temperature and humidity values (tc, ic), which may be constant or variable over time. The processing means P are provided for applying the formula for calculating the dew point temperature according to the desired temperature and humidity values and for controlling the heat exchanger means 120 and the heater means 180. The heat exchanger means 120 are controlled as a function of the temperature difference between the actual temperature t1 of the volume of water W in the bubbler means, detected by the sensor S1, and the temperature that the volume of water W must assume in the bubbler means to obtain the calculated temperature tb which the flow of air must assume. For example, possible alternatives of the temperature control strategy for the exchanger means and/or for the heater means are those wherein a desired temperature or an initially higher temperature is set to accelerate the heat exchange. The heater means 180 are controlled as a function of the temperature difference between the desired temperature tc and the temperature tb of the flow of air exiting the bubbler means and optionally adjusted as a function of the temperature difference between the actual temperature t2 detected by the sensor S2 and the desired tc temperature.

Figure 5:
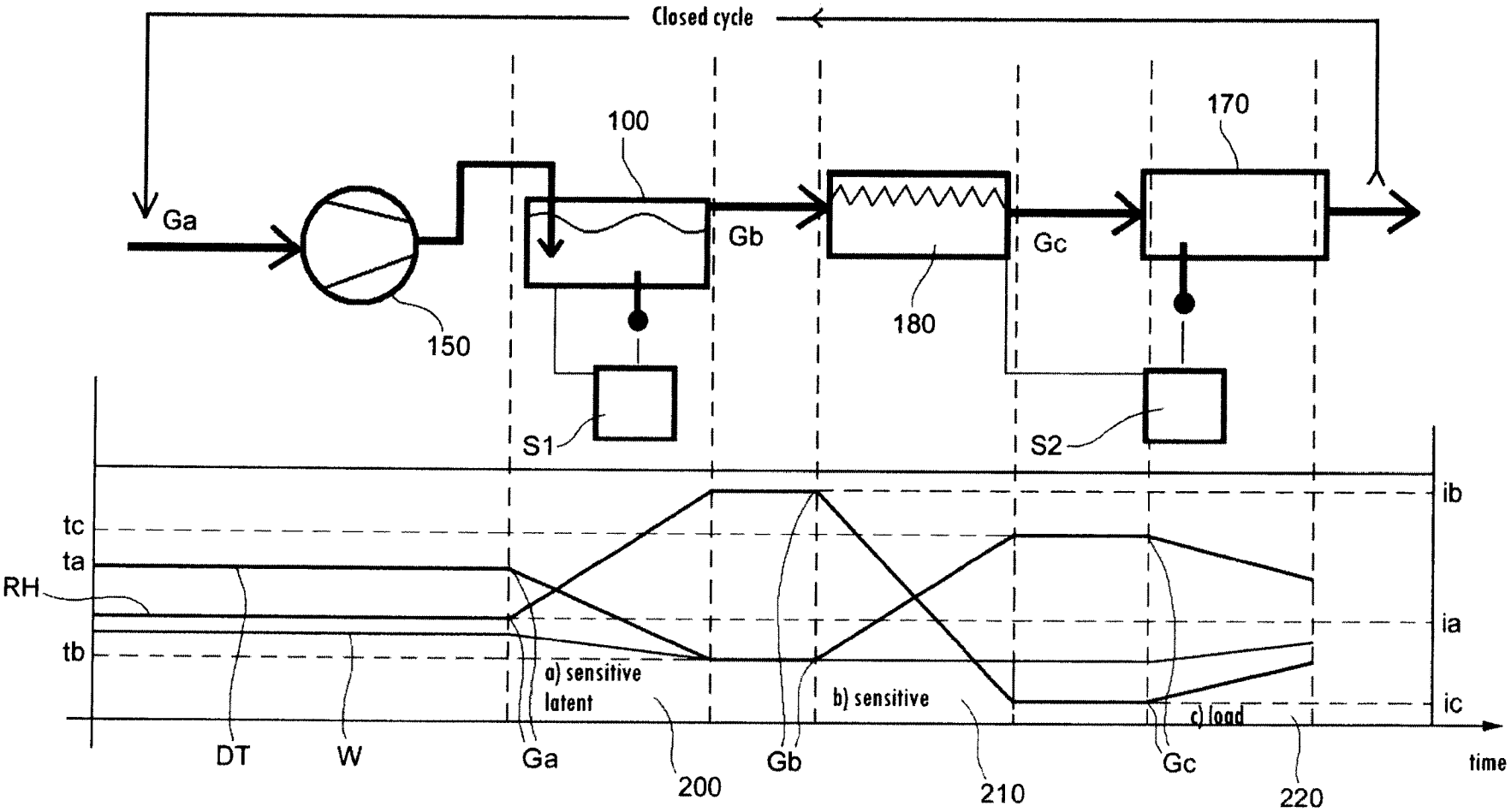
FIG. 5 illustrates an operating cycle divided among the various steps of conditioning the air in the climate generator.

FIG. 5 shows an operating cycle of the climate generator for conditioning a climatic chamber, specifically the DT, WT and RH curves that represent the temperature variations (when passing through the climate generator) that the flow of air Ga introduced in the climate generator undergoes in the various phases of air conditioning, the variations in temperature (over time) of the flow of water W present in the bubbling means, and the variations in humidity (in passing through the climate generator) which the flow of air Ga, introduced into the climate generator, undergoes in the various phases of air conditioning.

In particular, the graph shows a first step 200 of air conditioning in the passage of the flow of air Ga through the volume of water W present in the bubbler means, a second step 210 of air conditioning in the passage of the flow of air Gb in the heating battery 180 and a step 220 of varying the climatic parameters of the air at controlled temperature and relative humidity values (tc, ic), obtained by the climate generator, in the passage of the flow of air Gc in the climatic chamber 170.

Figure 6:
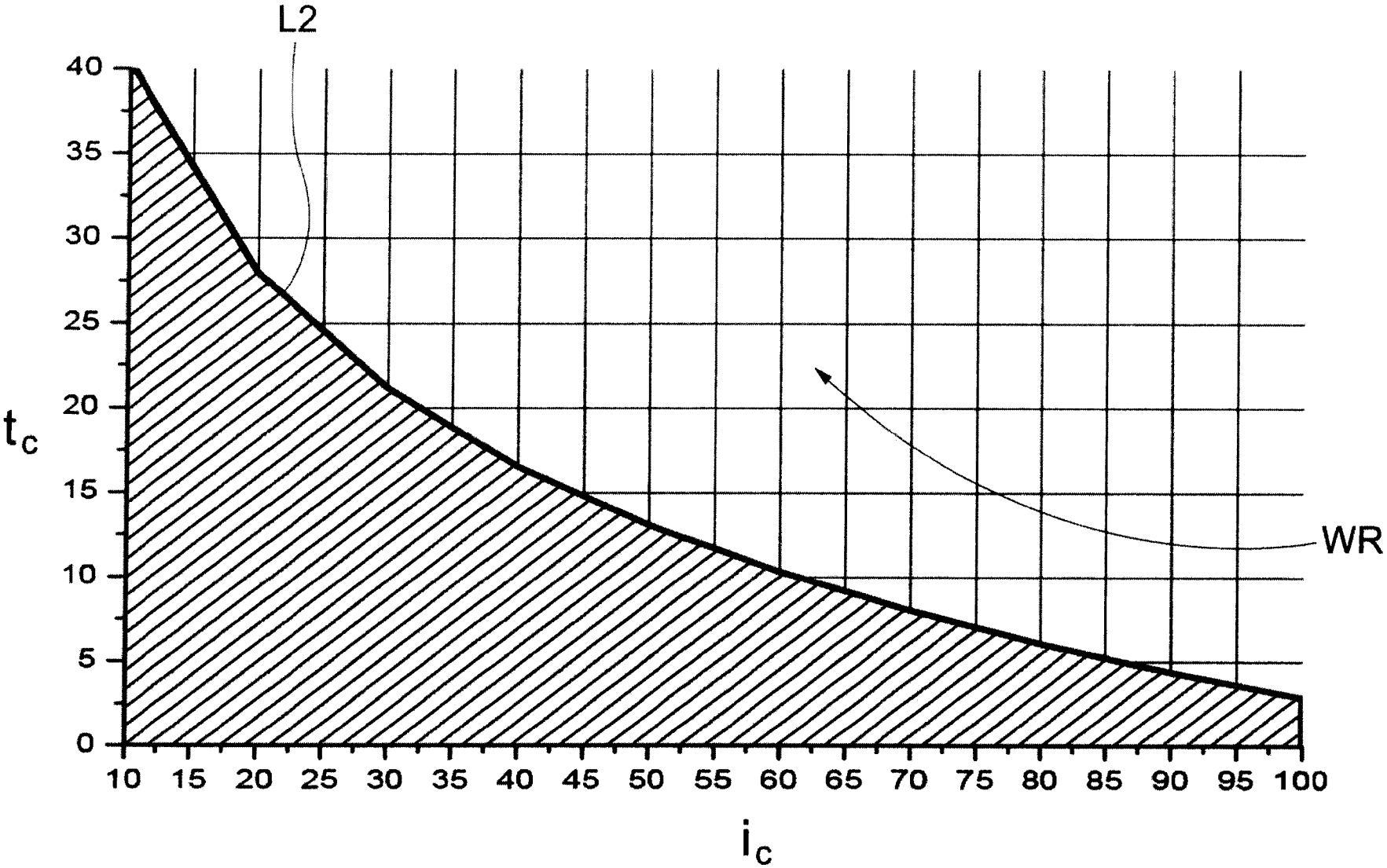
FIG. 6 illustrates a graph of the operating field of the climate generator object of the invention under stable conditions.
Figure 7A:
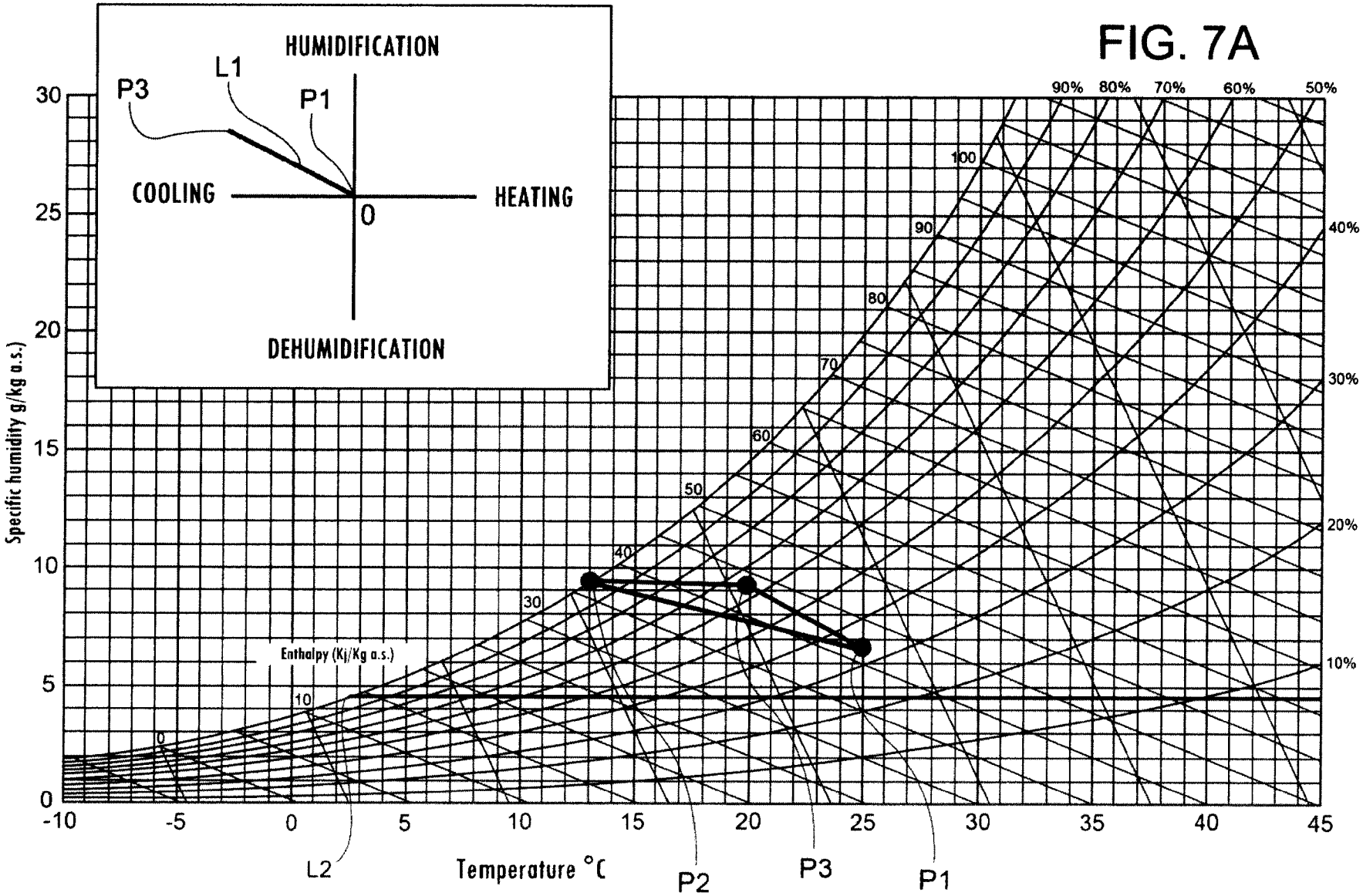
FIGS. 7A, 7B, 7C and 7D show examples of transformations of a flow of air obtainable with the dew point climate generator of the invention.
Figure 7B:
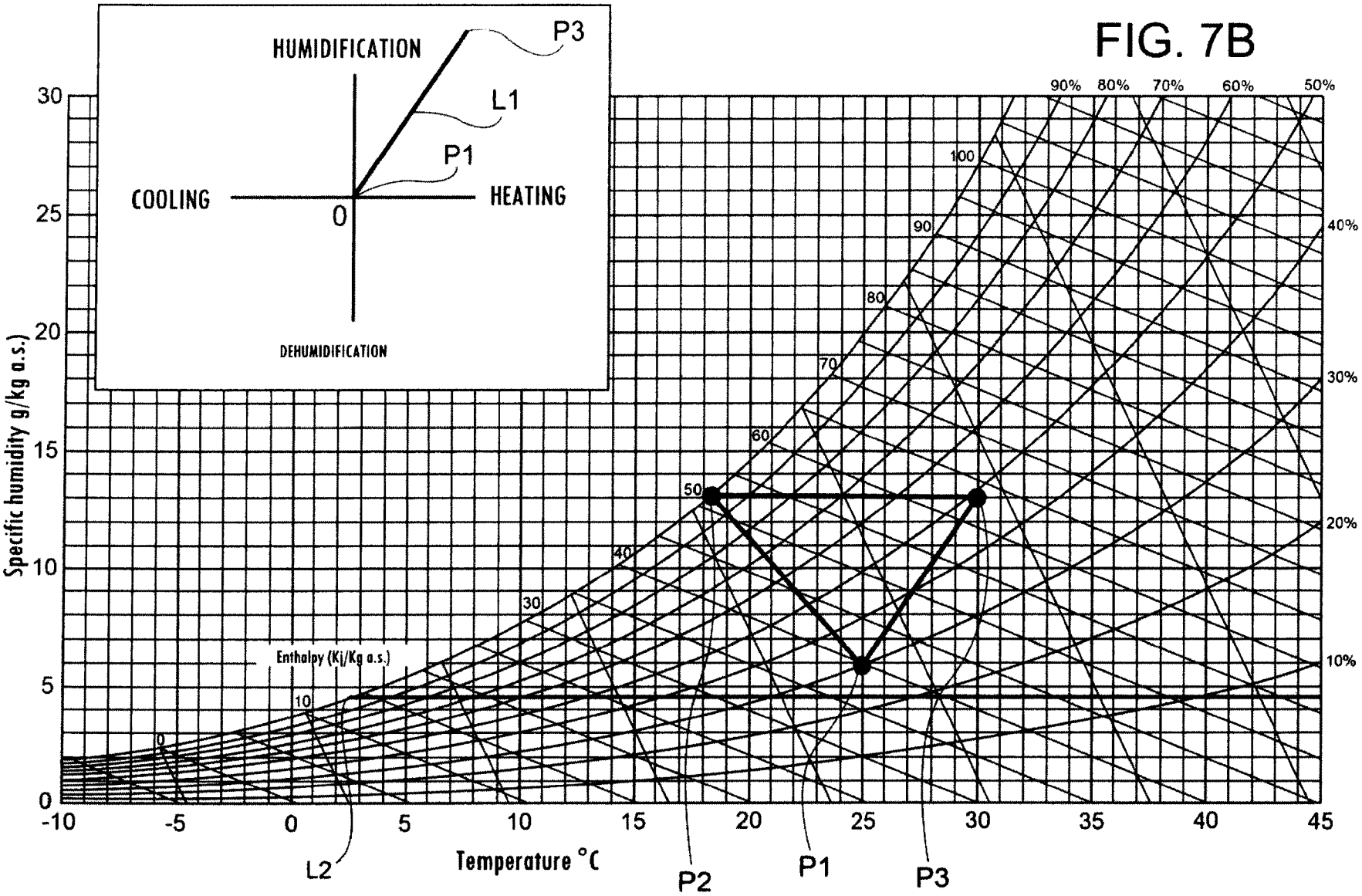
Figure 7C:
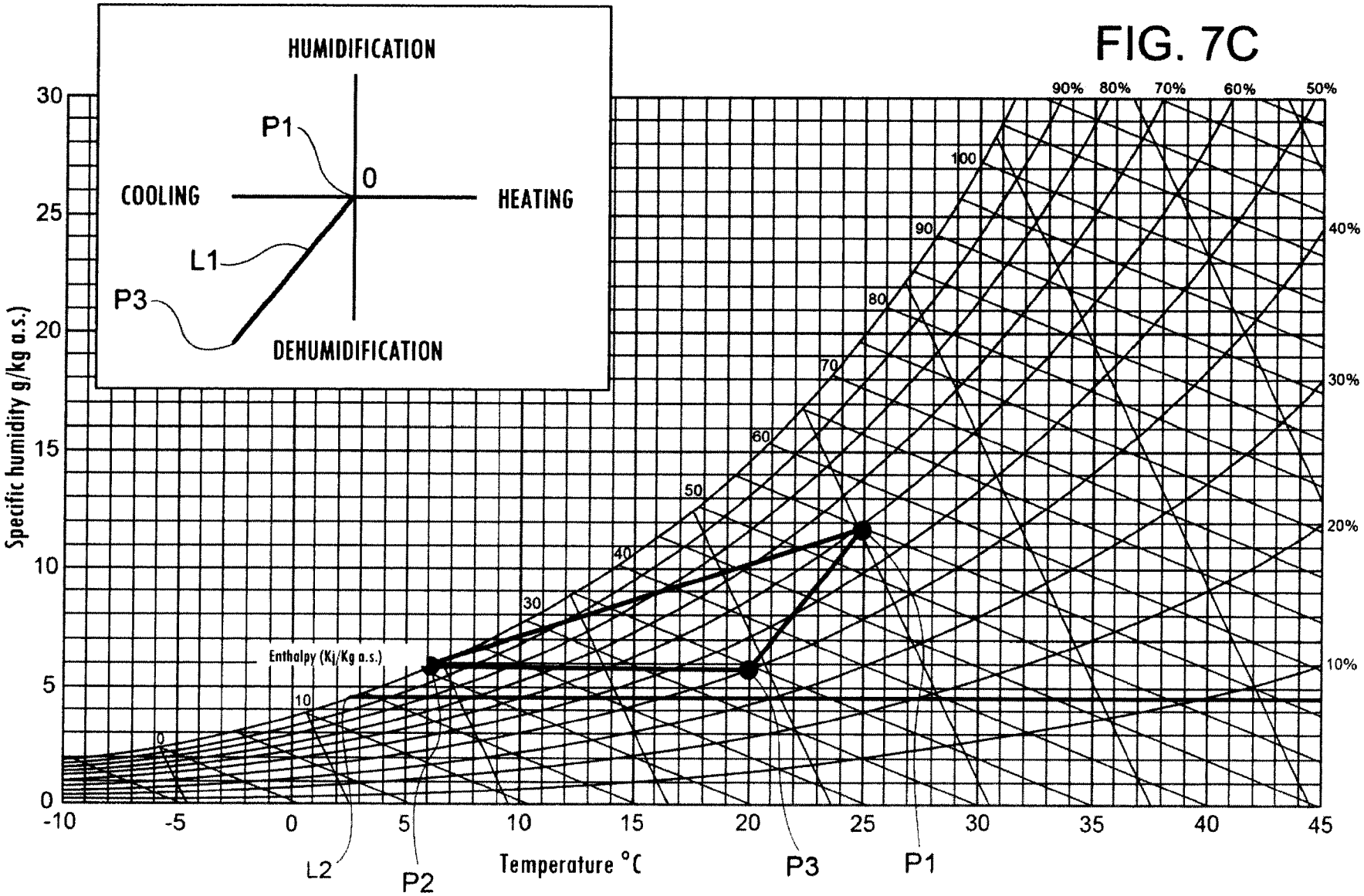
Figure 7D:
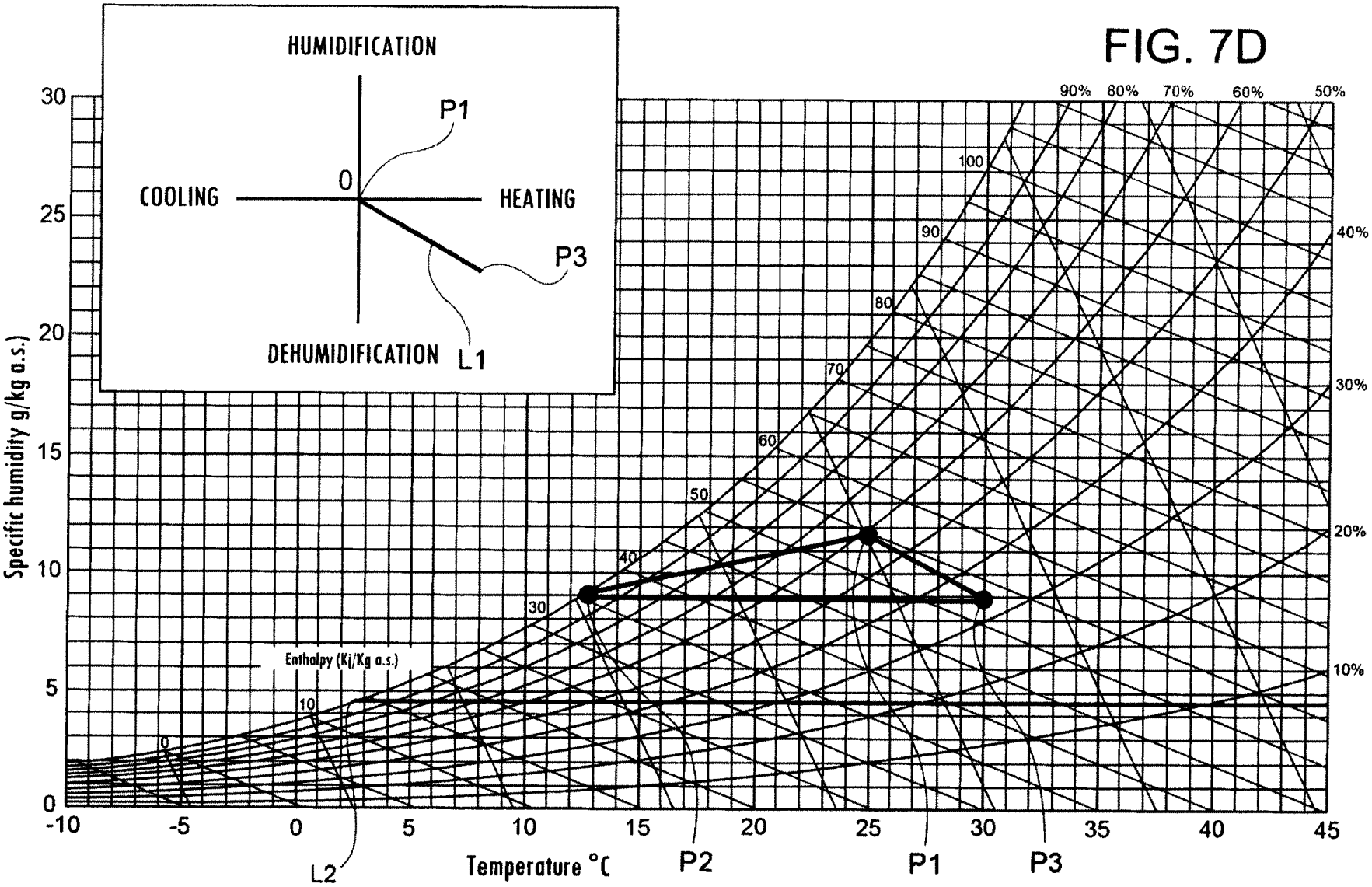

Within the limits of the theoretical operating field WR of the climate generator in stable conditions illustrated in FIG. 6, the climate generator through only two transformation phases controlled by two temperatures allows different climate configurations to be obtained and—in cyclic operation—to maintain stable climatic conditions in a chamber associated thereto.

The diagrams illustrated in FIGS. 7A, 7B, 7C and 7D, Mollier diagrams, represent the variations in temperature and humidity of a flow of air during treatment in the climate generator object of the invention. They indicate the temperature of the flow of air on the abscissa, the specific humidity of the flow of air on the ordinate, and show a sheaf of reference relative humidity curves, including the relative humidity curves at values of 100%, 90%, . . . , 0%.

Each figure also shows a box that qualitatively expresses the transformation made by the climate generator on the flow of air.

With reference to the diagrams illustrated in FIGS. 7A, 7B, 7C and 7D, the climate generator object of the invention allows an incoming flow of air Ga to be transformed, in particular according to the transformations "cooling-humidification", "heating-humidification". "cooling-dehumidification" and "heating-dehumidification".

In the graphs, point P1 indicates the conditions of the flow of air to be conditioned Ga (temperature ta, relative humidity ia) entering the climate generator, point P2 the conditions of the flow of air at the dew point Gb (temperature tb, relative humidity ib) to the bubbler means, and point P3 the desired conditions of the flow of air produced by the climate generator Gc (temperature tc, relative humidity ic), obtained when exiting the heater 180. The line L1 in the boxes indicates the overall transformation undergone by the flow of air, whereas the line L2 indicates the operating limits of the possible transformations (the line L2 represents the limit of the theoretical operating field WR of the climate generator shown in FIG. 6).

In a variant embodiment of a dynamic climate generator, the climate generator comprises bubbler means 100 which include a first bubbler and a second bubbler, the latter maintained at different water temperature conditions with respect to the water temperature of the first bubbler, for example through the use of the heat exchange battery 120 which, by means of a modulating valve adapted to regulate an intake flow of water in the first and second bubbler respectively, as a function of the water temperature, serves both the bubblers. Means for diverting the flow of air to be conditioned, such as, for example, a three-way valve, are adapted to selectively deviate the flow of air to be conditioned to the first bubbler or to the second bubbler.

In this way, it is possible to obtain a dynamic climate generator able to make sudden changes in relative humidity under isothermal conditions. Such a dynamic generator is necessary for some types of laboratory tests, as for example in the execution of some types of environmental simulation tests.

The advantage achieved by the climate generator and the corresponding climate conditioning process of the invention lies in the fact that only two transformation steps are necessary to control the climate of an environment. Due to this, less complexity, greater reliability, lower production costs and reduced maintenance on the climate generator are obtained, despite having a high field of use and a stable and accurate control of the climatic parameters of temperature and relative humidity.

Due to the need for dynamic systems where rapid and wide variations are required, the climate generator of the invention is highly efficient and has much more limited manufacturing costs compared to known laboratory equipment, which is mainly composed of a double climatic chamber served by a double climatic system.

Moreover, the treated air will be free of dust and pollutants due to the fact that the air passes through the water of the bubbler.

Naturally, without altering the principle of the invention, the embodiments and the details of implementation may vary widely with respect to that which is described and illustrated purely by way of non-limiting example, without thereby departing from the scope of protection of the invention defined by the accompanying claims.

What is claimed is:

1. A climate generator comprising:

a bubbler (100) adapted to receive a flow of air to be conditioned (Ga) having a first temperature (ta) and a first value of relative humidity (ia), comprising a predetermined volume of water (W) at a second temperature, which are adapted to emit a flow of air saturated with water vapor (Gb) at the second temperature;

a heat exchanger (120) associated with the bubbler (100), arranged to adjust the second temperature of the predetermined volume of water (W) and/or to provide a quantity of latent heat of evaporation to the predetermined volume of water (W); and a heater (180) adapted to heat the flow of air saturated with the water vapor (Gb) exiting from the bubbler (100) up to said a controlled temperature value of the flow of air (tc), wherein the second temperature is established according to the controlled temperature value (tc) and a controlled relative humidity value (ic) of the flow of air (Gc), so that the heating of the flow of air saturated with the water vapor (Gb) from the second temperature to the controlled temperature value results in a decrease of the relative humidity (ic) of the flow of air produced by the climate generator (Gc) to the controlled relative humidity value, and wherein the bubbler comprises a first bubbler and a second bubbler, wherein the predetermined volume of water is a first predetermined volume of water, and wherein the first bubbler is adapted to maintain the first predetermined volume of water at the second temperature and the second bubbler is adapted to maintain a second predetermined volume of water at a third temperature different from the second temperature, and wherein the bubbler further comprises a modulation valve adapted to regulate an incoming flow of water into the first bubbler and the second bubbler, respectively, and the heat exchanger being adapted to regulate respectively the second temperature of the first predetermined volume of water of the first bubbler and the third temperature of the second predetermined volume of water of the second bubbler.

2. The climate generator according to claim 1, further comprising an air pump operable to supply the flow of air to be conditioned (Ga) to the bubbler, and a conduit (130) having a path within the volume of water (W) and provided with a plurality of holes adapted to introduce the flow of air to be conditioned (Ga) in the bubbler (100), and wherein the air pump (150) is adapted to circulate the flow of air to be conditioned (Ga) in the conduit (130) and in the bubbler (100) at a pressure higher than the pressure of the volume of water (W) of the bubbler (100) so as to emerge from said predetermined volume of water.

3. The climate generator according to claim 1, wherein the bubbler (100) are closed-vessel and thermally insulated with a pressure seal, and the heat exchanger (120) are located within the bubbler (100).

4. The climate generator according to claim 1, wherein the bubbler (100) are open-vessel and the heat exchanger (120) are located outside the bubbler (100).

5. The climate generator according to claim 2, wherein the conduit (130) having a tortuous path is a porous tube (1300) located at a bottom of the bubbler (100).

6. The climate generator according to claim 2, further comprising an airflow collector (160) of the flow of air, adapted to collect the flow of air saturated with the water vapor (Gb) which exits from the bubbler (100) towards a climatic chamber (170) served by the climate generator; the airflow collector (160) of the flow of air being located in an upper part of the bubbler (100).

7. The climate generator according to claim 1, further comprising a PID control operable to adjust the second temperature of the predetermined volume of water (W) of the bubbler (100).

8. The climate generator according to claim 1, wherein the bubbler (100) comprises a valve adapted to selectively deviate the flow of air to be conditioned to the first bubbler or the second bubbler.

9. The climate generator according to claim 6, wherein the airflow collector is further adapted to extract the flow of air from the climatic chamber (170).

10. A climate conditioning process comprising:

introducing a flow of air to be conditioned (Ga) having a first temperature (ta) and a first relative humidity value (ia) in a bubbler (100) comprising a first predetermined volume of water (W) to a second temperature;

regulating the second temperature of the first predetermined volume of water (W) and/or providing a quantity of latent heat of evaporation to the first predetermined volume of water (W);

obtaining a flow of saturated water vapor (Gb) at the second temperature which exits from the bubbler (100);

heating the flow of air with the water vapor (Gb) exiting from the bubbler means (100) up to a controlled temperature value (tc) of the flow of air (Gc), wherein the second temperature is established according to the controlled temperature value (tc) and a controlled relative humidity value (ic) of the flow of air, so that the heating of the flow of air saturated with the water vapor (Gb) from the second temperature up to the controlled temperature value causes a decrease of the relative humidity (ic) of the flow of air (Gc) to the controlled relative humidity value (ic), and wherein the bubbler comprises a second bubbler, and wherein the first bubbler is adapted to maintain the first predetermined volume of water at the second temperature and the second bubbler is adapted to maintain a second predetermined volume of water at a third temperature different from the second temperature, and wherein the bubbler further comprises a modulation valve adapted to regulate an incoming flow of water into the first bubbler and the second bubbler, respectively, and the heat exchanger being adapted to regulate respectively the second temperature of the first predetermined volume of water of the first bubbler and the third temperature of the second predetermined volume of water of the second bubbler.

11. The climate conditioning process according to claim 10, wherein the flow of air to be conditioned (Ga) is introduced in the bubbler (100) at a pressure higher than the pressure of the first predetermined volume of water (W) of the first bubbler (100), so as to emerge from the first predetermined volume of water.

* * * * *